United States Patent [19]

Miller, Sr.

[11] Patent Number: 5,056,448

[45] Date of Patent: Oct. 15, 1991

[54] PVC BOAT

[76] Inventor: Terry L. Miller, Sr., P.O. Box 162, Afton, Okla. 74331

[21] Appl. No.: 495,402

[22] Filed: Mar. 19, 1990

[51] Int. Cl.[5] ..... B63B 1/00

[52] U.S. Cl. ..... 114/61; 114/357; 114/85

[58] Field of Search ..... 114/352, 354–357, 114/81, 85, 61, 59, 283, 266, 267; 441/43–46, 129

[56] References Cited

U.S. PATENT DOCUMENTS

| | | | |
|---|---|---|---|
| 2,775,218 | 12/1956 | Kapusnyk | 114/61 |
| 3,210,783 | 10/1965 | Petty | 114/61 X |
| 3,758,897 | 9/1973 | Shaw | 441/45 |
| 3,857,352 | 12/1974 | Schott | 114/61 |
| 4,487,588 | 12/1984 | Lewis, III et al. | 441/45 X |

*Primary Examiner*—Ed Swinehart

[57] ABSTRACT

A boat built up entirely from polyvinyl chloride pipe sections and pipe fittings including a pair of pontoons joined together by transverse members and a deck frame adhesively joined to the pontoons and having cross members for receiving a deck.

2 Claims, 2 Drawing Sheets

PVC BOAT

BACKGROUND OF THE INVENTION

This invention relates to boats. More particularly, the invention relates to a pontoon type boat.

Boats, including more modest pontoon type boats, are relatively expensive recreational items for the typical working person. Pontoon type boats are very popular recreational boats however, as noted, their cost can be prohibitively high for the average working person Accordingly, it is the object of the present invention to provide for a boat construction that lowers the cost of such boats thus making them available to more persons. Heretofore, the construction of pontoon type boats has included processes for forming the pontoon portions of the boat from metal such as aluminium or from fiberglass reinforced plastics with the platform portion of the boat and super structure typically formed from expensive metal plate and or fiberglass reinforced plastic panels. As noted, these materials and the processing and assembly associated therewith into the desired final product are expensive and place the cost of such boats out of the reach of many people who would otherwise desire to own such a boat.

SUMMARY OF THE INVENTION

The present invention overcomes the shortcomings of the prior art by providing for a boat structure that is made up entirely of common, readily available and reasonably inexpensive parts that can be assembled cost effectively either by a manufacturer or in a kit form by a potential user of the boat.

According to the invention, the boat comprises a plurality of polyvinyl chloride [PVC] pipe sections and pipe fittings that are adhesively joined together to form a pontoon type boat.

According to a preferred embodiment, a plurality of the PVC pipe sections are joined by way of a plurality of novel PVC pontoon connectors into a pair of pontoons.

According to an important feature of the invention, the pontoon connectors provide for connecting transverse members between the pontoons and for adhesively connecting a deck frame to the pontoons.

According to the invention, the pontoon connectors also include provision for adhesively connecting a support strut between each pontoon connector and each transverse member to strengthen the structure.

According to another important feature of the invention, the deck frame is provided with upstanding rails along portions of it's perimeter which are also comprised of adhesively joined PVC pipe sections and pipe fittings.

According to a still further important feature, the deck frame carries a boat deck comprised of deck planking attached to the deck frame.

The invention further provides for a method of assembling a pontoon type boat including the steps of adhesively joining together a plurality of PVC pipe sections into a pair of spaced apart parallel pontoons, adhesively connecting a plurality of PVC pipe transverse members between the pair of pontoons, adhesively joining together the plurality of PVC pipe sections and fittings to form a deck frame and adhesively joining the deck frame to the pair of pontoons.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
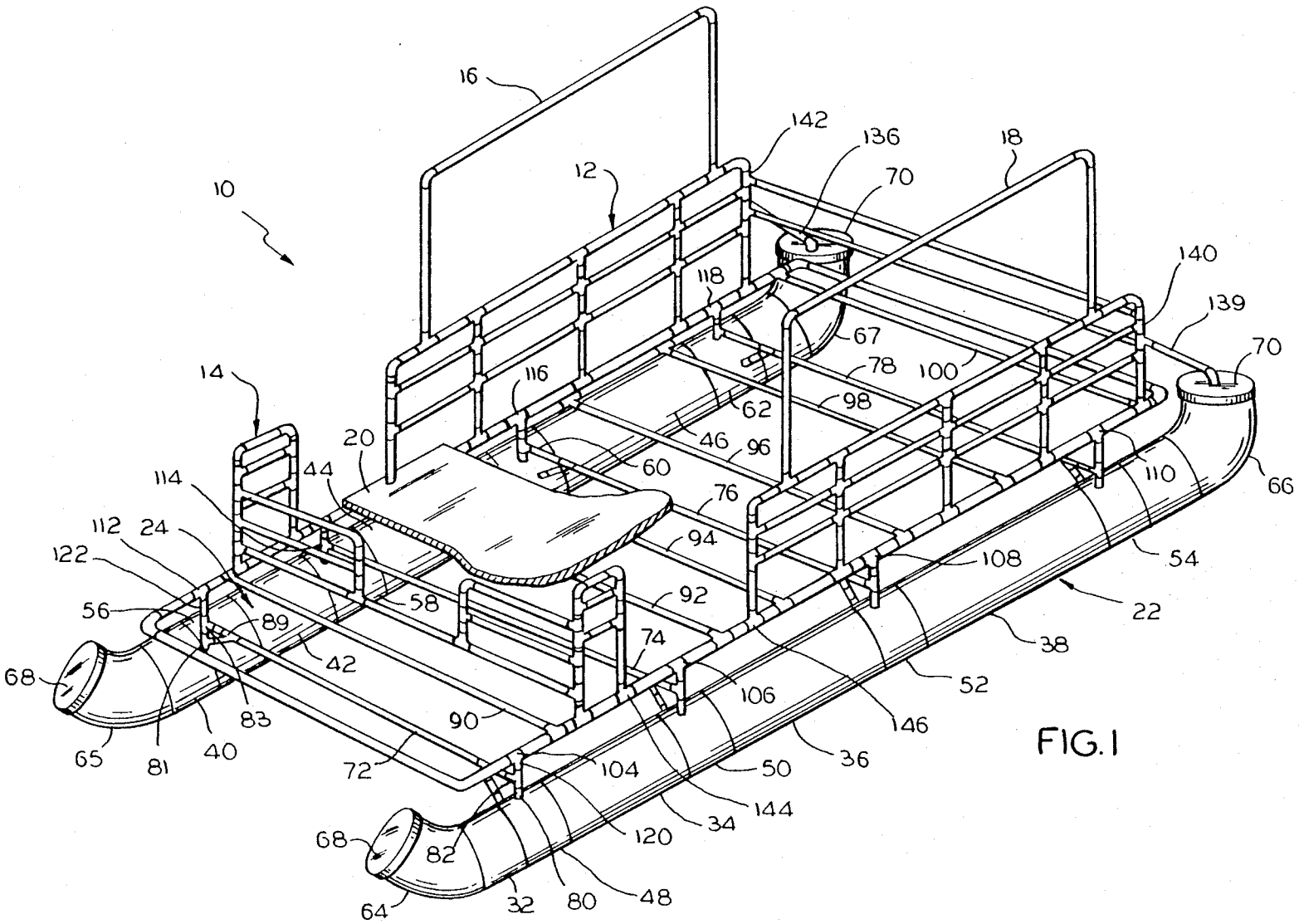
FIG. 1 is a pictorial view of a preferred embodiment of a PVC boat constructed according to the invention showing details of construction.

Shown in FIG. 1 is a pontoon type boat 10 constructed according to the invention. It should be noted that the invention is not to be considered limited to the specific configuration disclosed but rather, the configuration is representative only. For example, the construction shown includes an upstanding fence or rail shown in FIG. 1 generally as including portions 12 and 14 which substantially, entirely encircles the occupant deck area and a pair of higher rails 16, 18. This rail or fence configuration, as noted, is only representative and those skilled in the art having the benefit of the description can readily provide other rail or fence and deck area configurations and structures from those described here.

Figure 2:
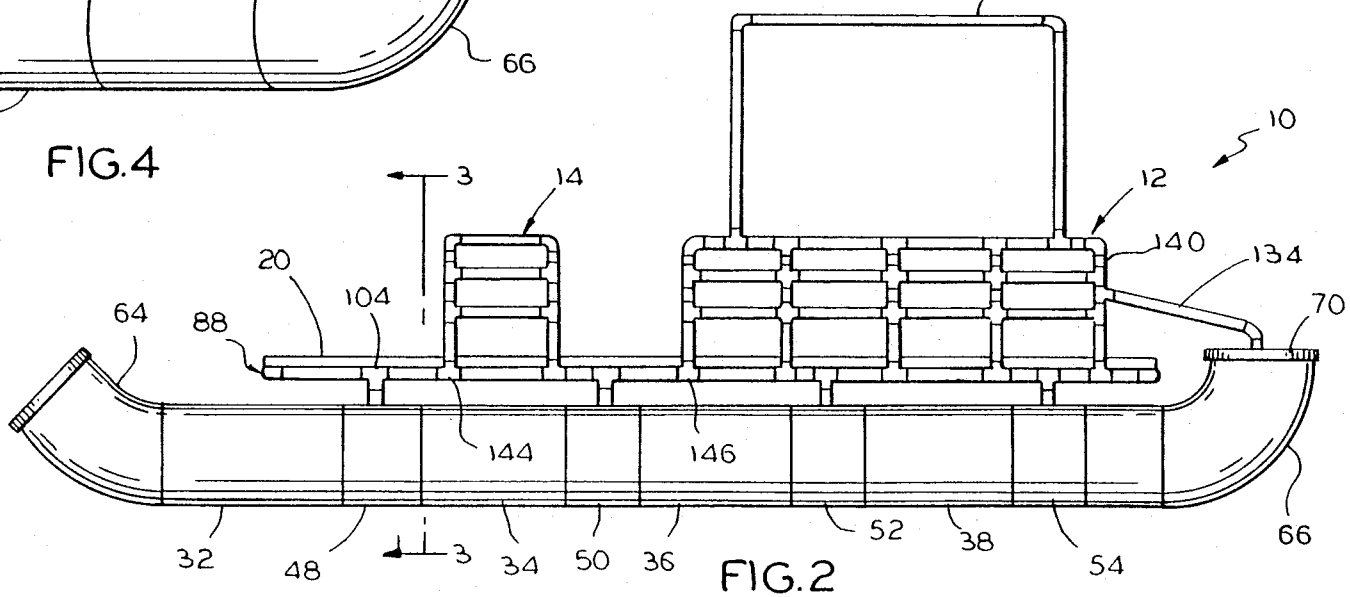
FIG. 2 is a side elevational view of the PVC boat of FIG. 1 showing details of construction.

Still referring to FIG. 1, except for a deck 20, the boat 10 is constructed entirely of polyvinyl chloride [hereafter referred to as PVC] pipe sections and pipe fittings. A pair of pontoons 22, 24 are assembled from a plurality of pipe sections. In the embodiment shown, each pontoon is built up from, for example, four pipe sections 32, 34, 36, 38 and 40, 42, 44, 46 respectively by adhesively, coaxially joining the sections together by way of intermediately positioned pontoon connectors 48, 50, 52, 54 and 56, 58, 60, 62 respectively. As shown in FIGS. 1 and 2, each pontoon is also provided with an upwardly angled pipe section at its fore and aft ends. Preferrably, the forward sections are 45 degree PVC elbows 64, 65 and the aft sections are 90 degree PVC elbows 66, 67. Each forward section 64, 65 and each aft section 66, 67 is provided with closure caps 68, 70.

Figure 3:
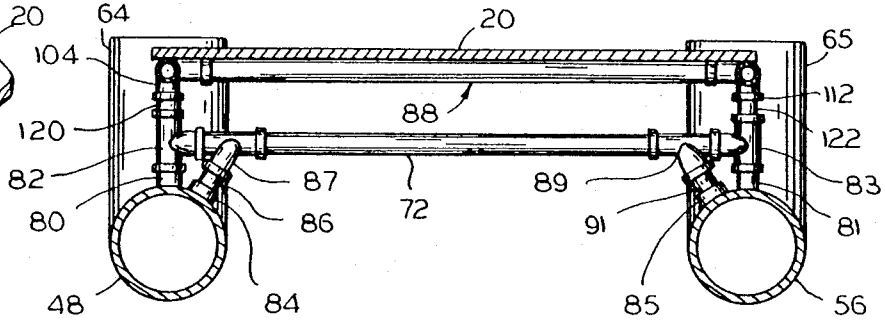
FIG. 3 is a cross sectional view taken along the line 3—3 in FIG. 2 showing further details of construction.

The pontoons are maintained in a spaced apart parallel relationship by a plurality of parallel spaced apart transverse members 72, 74, 76, 78 extending between the pontoons at each pontoon connector. Connection of the transverse members is shown best in FIG. 3 which shows one such transverse member 72 so connected. Each pontoon connector, 48, 56 shown in FIG. 3, is provided with an upwardly extending pipe section, 80, 81 shown in FIG. 3, for adhesive attachment to a lower connection of T-fittings 82, 83 respectively. Each transverse member, for example member 72 in FIG. 3, is adhesively secured to aligned laterally facing connections of T-fittings as shown in FIG. 3. Preferrably, each pontoon connector is additionally provided with an angularly inwardly, upwardly extending fitting, 84, 85 shown in FIG. 3, and each transverse member is provided with a Y-fitting, 87, 89 in FIG. 3, proximate its opposite ends for adhesively securing a pair of strut sections, 86, 91 in FIG. 3, between each pontoon connector and each transverse member to add strength and rigidity to the pontoon frame. FIG. 3 shows the connection of one transverse member and strut pair at only one pair of pontoon connectors. Preferrably, there is a transverse member and struts connected between each pair of pontoon connectors.

Referring principally to FIGS. 1 and 3, the boat is provided with a deck frame shown generally as 88 built up from a plurality of PVC pipe sections and pipe fittings. In the embodiment shown, the deck frame is rectangular including perimeteral members formed from the various pipe sections and fittings. The deck frame 88 includes a plurality of cross members 90, 92, 94, 96, 98, 100 to which the deck in the form of deck planking or board 20 is fastened. At locations along the perimeter of the deck frame corresponding to each pontoon connector, the deck frame perimeteral members are provided with depending T-fittings 104, 106, 108, 110, 112, 114, 116, 118. As shown in FIG. 3, vertical pipe sections, for example 120, 122, are adhesively secured to the aligned upwardly facing connections on the T-fittings 82, 83 on the pontoon connectors and downwardly facing connections on the T-fittings 104, 112 on the deck frame to thereby mount the deck frame to the pontoons in a horizontal plane above and extending between the pontoons. It can be seen that the attachment construction of the deck frame to the pontoons provides for positioning the deck frame at any heigth above the pontoons desired by appropriately changing the length of the vertical pipe sections 120, 122.

Figure 4:
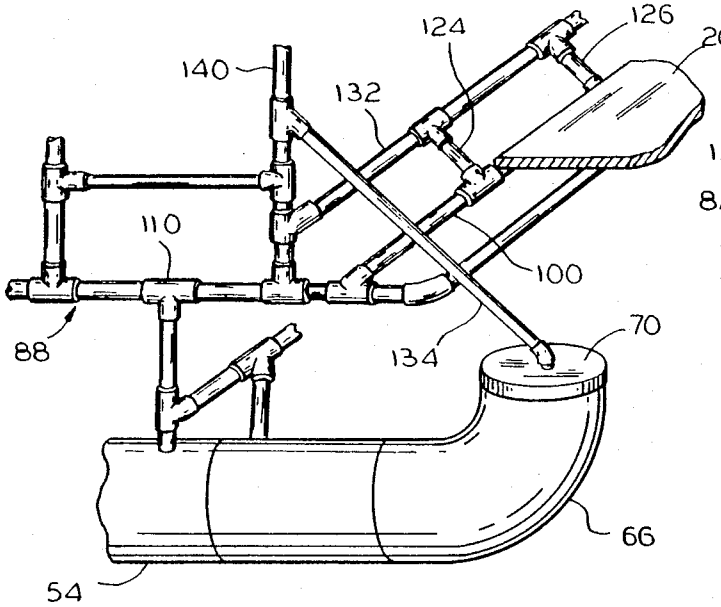
FIG. 4 is an enlarged partial view of an aft portion of the PVC boat in FIG. 1 showing further details of construction.

It is preferred that the aft portion of the deck frame be provided with additional support since that portion may be required to carry the additional weight of an outboard motor. One structure for adding rigidity and strength to the aft portion is shown in FIG. 4 where a plurality of short angular tension struts, only two struts 124, 126 being shown in FIG. 4, are adhesively joined between the aft cross member, 100 in FIG. 4, of the deck frame and an aft transverse rail member, 132 in FIG. 4. These tension struts help to vertically support the overhanging aft portion of the deck frame. Additional compression struts 134, 136 can also be provided between each pontoon and an upstanding portion of the deck rail. For example, as shown in FIGS. 1 and 4, compression struts 134, 136 are adhesively secured to the end caps 70 of each aft pontoon section 66, 67 and to aft corner posts 140, 142 of the deck rail assembly.

As shown in FIGS. 1 and 2, the deck frame 88 is provided with a fence or rail system 12, 14 of any preferred configuration also formed by adhesively joining together various PVC pipe sections and fittings into the desired shape and adhesively connecting the formed rail to the perimeter of the deck frame by appropriate T-fittings, such as T-fittings 144, 146. As noted, the fence shown substantially encircles the deck area of the boat leaving access openings in the fence for occupant entrance and exit but, as noted, other fence configurations can be provided as desired.

It can be seen that a PVC pipe boat such as that described is easily constructed by persons of average mechanical skills by following simple parts lists and assembly steps which would include: providing for a plurality of PVC pipe sections and pipe fittings of predetermined size to yield the size and configuration of boat desired; adhesively joining the PVC pipe sections and pipe fittings together to form a pair of elongated pontoon sections; adhesively joining transverse members between the pontoon sections to hold the pontoon sections in spaced apart parallel relationship; adhesively joining together a plurality of pipe sections and pipe fittings to form a deck frame having cross-members, and; adhesively joining the deck frame to the pontoons.

Although, as noted, many configurations are possible, it is contemplated that a preferred PVC boat according to the invention would have each pontoon comprised of four 24 inch diameter 4 feet long PVC pipe sections and four 24 inch diameter 1 foot long pontoon connectors. The transverse members and deck members could be constructed preferrably of 3 inch diameter PVC pipe and pipe fittings and the deck fence or rails could be constructed of 2 inch diameter PVC pipe sections and pipe fittings. It is also contemplated that the overall length of such a boat would be on the order of about 24 feet and have a width of about 8 feet.

Having described the preferred embodiment of the invention, those skilled in the art having the benefit of this description can readily devise other embodiments and modifications which are to be considered to be within the scope of the appended claims.

What is claimed is:

1. A boat comprising:

a pair of elongated spaced apart parallel pontoons formed by a plurality of tubular polyvinyl chloride pontoon pipe sections coaxially adhesively connected together by a plurality of tubular polyvinyl chloride pontoon pipe section connectors having a perimeteral shape and size substantially equal to the perimeteral shape and size of said pontoon pipe sections;

a plurality of parallel spaced apart polyvinyl chloride transverse members connected between said pontoons;

a deck frame formed by a plurality of polyvinyl chloride pipes and pipe fittings adhesively secured together to form a perimeteral portion and a plurality of spaced apart parallel cross members connected between opposing portions of said perimeteral portion, said deck frame including a plurality of mounting members;

each pontoon pipe section connector including a polyvinyl chloride pipe T-fitting having three attachment connections, one attachment connection of each T-fitting adhesively connected to one of said pontoon pipe section connectors, a second attachment connection of each T-fitting adhesively connected to an end of one of said transverse members and a third attachment connection of each T-fitting adhesively connected to one of said mounting members on said deck frame.

2. The boat as defined in claim 1 wherein each of said transverse members nd each of said pontoon pipe connectors is adapted to attach an angularly dispose strut between said transverse member and said pontoon pipe section connector.

* * * * *